US005560098A

United States Patent [19]

Robins

[11] Patent Number: 5,560,098

[45] Date of Patent: Oct. 1, 1996

[54] METHOD OF MAKING AN ELECTRICAL CONNECTION TO THICK FILM TRACKS

[75] Inventor: Ian Robins, Hillingdon, England

[73] Assignee: Central Research Laboratories Limited, Middlesex, England

[21] Appl. No.: 374,568

[22] PCT Filed: Jul. 2, 1993

[86] PCT No.: PCT/GB93/01391

§ 371 Date: Jan. 20, 1995

§ 102(e) Date: Jan. 20, 1995

[87] PCT Pub. No.: WO94/03027

PCT Pub. Date: Feb. 3, 1994

[30] Foreign Application Priority Data

Jul. 22, 1992 [GB] United Kingdom ..... 9215586

[51] Int. Cl.[6] ..... H01C 17/28

[52] U.S. Cl. ..... 29/621; 29/854; 338/310; 338/331

[58] Field of Search ..... 29/621, 850, 854, 29/855, 857, 865; 338/310, 311, 323, 331

[56] References Cited

U.S. PATENT DOCUMENTS

| | | | |
|---|---|---|---|
| 3,672,047 | 6/1972 | Sakamoto et al. | 29/854 |
| 3,733,685 | 5/1973 | Kauppila | 29/854 |
| 4,164,067 | 8/1979 | Branat et al. | 29/621 |

FOREIGN PATENT DOCUMENTS

| | | |
|---|---|---|
| 386918 | 9/1990 | European Pat. Off. . |
| 1124571 | 3/1962 | Germany . |
| 1590363 | 4/1970 | Germany . |
| 2442717 | 3/1976 | Germany . |
| 8071549 | 3/1987 | WIPO . |

*Primary Examiner*—P. W. Echols
*Attorney, Agent, or Firm*—Keck, Mahin & Cate

[57] ABSTRACT

A method of making an electrical connection of a conductor (1) to a thick film track (2) mounted on a substrate (3) includes the steps of heating the conductor (1) to a temperature at which it may melt the glass constituent of the track (2), and inserting it into the track (2) such that it sinks in and contacts the metallic constituent of the track. The glass sets, fixing the conductor in place. Thus the need for a second firing operation is avoided.

8 Claims, 1 Drawing Sheet

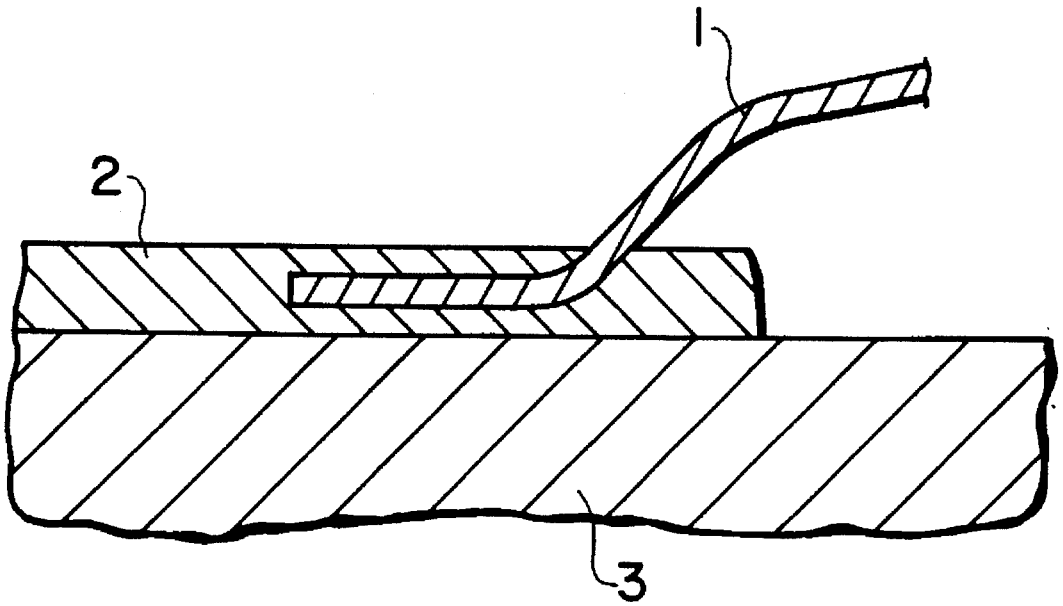
1
2
3

METHOD OF MAKING AN ELECTRICAL CONNECTION TO THICK FILM TRACKS

This invention relates to the making of electrical connections to thick film tracks.

Thick film heaters comprise a track of electrically resistive material provided on a substrate. The track is formed by depositing an electrically conductive ink on the substrate, which ink comprises a finely divided metal mixed with a glass frit. After the ink has been deposited on the substrate, it undergoes a firing or furnacing operation which causes the glass frit to melt and produce a continuous glass layer with metal particles dispersed therein. The metal particles contact each other, and also are sintered together to some degree by the furnacing operation, such that they form a conductive pathway through the track.

Known methods of connecting an electrically conductive element to a thick film track, for example in order to connect it to a power supply, have involved expensive equipment or lengthy procedures. For example, soldering the conductor onto the track involves the printing and furnacing of an additional ink layer. Conductive epoxy adhesives can be used, but they are expensive, and are only suitable for use at temperatures below about 135° C. Wire bonding or gold ball bonding requires the use of expensive equipment.

It is an object of the present invention to alleviate the above problems.

According to the present invention, there is provided a method of connecting an electrically conductive element to a thick film track of electrically resistive material provided on a substrate, the material having a metal constituent and a glass constituent, the method comprising the steps of: heating the element to a temperature above the melting point of the glass constituent of the track, inserting the element into the track and allowing the element to cool.

As the thermal mass of the conductive element is small relative to that of the track it can be arranged that only a portion of the track immediately surrounding the element melts, and hence the other parts of the track and substrate are not damaged. Furthermore, the glass in the track may set rapidly to fix the element into the track.

This method is quick and simple, and can easily be performed without the need for a special environment or equipment. For example, the conductive element may be heated by a flame. Consequently it can be a relatively inexpensive method.

An embodiment of the invention will now be described, by way of example, with reference to the accompanying diagrammatic drawing which is a cross-sectional view of a connection of an electrically conductive element to a thick film track.

In the drawing a wire element 1 is shown fixed within a thick film track 2 mounted on the substrate 3. The connection is made as follows.

The wire 1, in this example of stainless steel, is heated to a dull red heat, corresponding to a temperature of about 800° to 900°. The track 2 has a glass constituent which suitably comprises glass marketed as 'Epsom A' by the Epsom Glass Company, and a metal constituent which may comprise copper and nickel particles.

Since the wire 1 is hot enough to melt the glass, which has a melting point around 700°, it sinks into the track 2 where connection to the metal constituent of the track 2 is provided both by physical contact of the wire 1 and the metal particles, and by a small amount of sintering of the wire 1 to the particles. The wire 1 is then allowed to cool such that the class constituent of the track 2 sets, and the wire 1 is fixed in place.

In order to prevent possible oxidation of the metal constituent of the track metals may be used which form a negligible amount of oxide under the conditions of the method. Such metals include platinum, palladium or silver. The wire element may also suitably comprise such metals. Alternatively or in addition, at least the area of the connection may be bathed in a non-oxidizing atmosphere, such as nitrogen, while the element is heated and inserted into the track.

Several conductive elements may be connected to the track, for example in dependence upon the current carrying capacity required. A thicker layer of ink may be provided in the region(s) of the connection(s) when printing the track to ensure that the track is sufficiently deep to surround the element or elements.

I claim:

1. A method of connecting an electrically conductive element to a thick film track of electrically resistive material provided on a substrate, the material having a metal constituent and a glass constituent, characterized in that the method comprises the steps of: heating the element to a temperature above the melting point of the glass constituent, inserting the element into the track, and allowing the element to cool.

2. A method as claimed in claim 1, wherein the element is heated by a flame.

3. A method as claimed in claim 1, wherein the conductive element is metallic.

4. A method as claimed in claim 3, wherein the element comprises metal which forms a negligible amount of oxide under the conditions of the method.

5. A method as claimed in claim 4 wherein the metal constituent of the track comprises a metal which forms a negligible amount of oxide under the conditions of the method.

6. A method as claimed in claim 3, wherein the area of the connection is bathed in a non-oxidising atmosphere during the steps of heating the element and inserting it into the track.

7. A method as claimed in claim 1, wherein a plurality of electrically conductive elements are connected to the track.

8. A method as claimed in claim 1, wherein the track is thicker in the region of the connection(s) than elsewhere along its length.

* * * * *